US007611019B2

(12) United States Patent
Alvarado

(10) Patent No.: US 7,611,019 B2
(45) Date of Patent: Nov. 3, 2009

(54) RACK WITH SIDE PROTECTORS FOR HOLDING PACKS OF PLASTIC BAGS

(75) Inventor: Rafael A. Alvarado, Houston, TX (US)

(73) Assignee: Better Bags, Inc., Houston, TX (US)

( * ) Notice: Subject to any disclaimer, the term of this patent is extended or adjusted under 35 U.S.C. 154(b) by 180 days.

(21) Appl. No.: 11/320,067

(22) Filed: Dec. 28, 2005

(65) Prior Publication Data

US 2007/0144989 A1 Jun. 28, 2007

(51) Int. Cl.
*A47G 29/00* (2006.01)

(52) U.S. Cl. ..... 211/85.15; 211/12

(58) Field of Classification Search ..... 211/85.15, 211/85.31, 12, 50, 181.1; 248/95, 99–101; D6/515, 517, 566; 224/925; 206/554; 383/8, 383/30

See application file for complete search history.

(56) References Cited

U.S. PATENT DOCUMENTS 4,199,122 A * 4/1980 Christie ..... 248/97
D264,651 S * 6/1982 Adamson ..... D6/566
D264,653 S * 6/1982 Adamson ..... D6/566
D264,905 S * 6/1982 Adamson ..... D6/566
D273,159 S * 3/1984 Adamson et al. ..... D6/566
4,487,388 A * 12/1984 Provan ..... 248/97
4,723,743 A * 2/1988 Jenkins ..... 248/97
4,750,694 A * 6/1988 Bateman ..... 248/97
4,819,899 A * 4/1989 Weil ..... 248/97
4,821,985 A * 4/1989 DeMatteis et al. ..... 248/97
4,840,336 A * 6/1989 Stroh et al. ..... 248/97
4,863,125 A * 9/1989 Bateman ..... 248/97
4,998,694 A * 3/1991 Barteaux ..... 248/100
5,012,994 A * 5/1991 Keefe ..... 248/558
5,979,841 A * 11/1999 Piraneo et al. ..... 248/95
6,042,063 A * 3/2000 Kerr et al. ..... 248/100
6,089,514 A * 7/2000 Huang et al. ..... 248/99
6,382,429 B1 * 5/2002 Yeh et al. ..... 211/59.1
7,066,389 B2 * 6/2006 Dickover et al. ..... 235/383
7,175,139 B2 * 2/2007 Broeders ..... 248/95
D552,901 S * 10/2007 Wilfong et al. ..... D6/515
2007/0095989 A1 * 5/2007 Spater et al. ..... 248/100
2007/0176058 A1 * 8/2007 Kohn et al. ..... 248/100

* cited by examiner

*Primary Examiner*—Jennifer E. Novosad
(74) *Attorney, Agent, or Firm*—Triantaphyllis Law Firm; Anastassios Triantaphyllis

(57) ABSTRACT

A rack for hanging packs of plastic bags, the rack having side protectors to direct attention to the top center of the front of a bag to ease opening of the bag.

26 Claims, 2 Drawing Sheets

RACK WITH SIDE PROTECTORS FOR HOLDING PACKS OF PLASTIC BAGS

BACKGROUND OF THE INVENTION

1. Field of the Invention

The present invention relates to a rack for holding packs of plastic bags of the type having an upper disposable portion and a lower bag portion. The rack has side protectors which direct a user's attention to the top and center of the front of the bag and significantly improve opening and using the bag.

2. Description of the Related Art

In supermarkets and other retail outlets, there is frequently the need for consumers or store employees to place items in bags to facilitate handling and purchase. For example, produce bags are dispensed directly to customers wherein the customer can bag produce as it is chosen for purchase. Also, in deli or meat departments, store employees place meats and other deli products in bags for the consumer. Further, in bakery departments, store employees place the selected bakery products in bags for the consumer. In the prior art, there are a number of designs for dispensing bags for these purposes.

Roll mounted produce bags are commonly found in modern grocery stores and supermarkets. These bags are designed for customers to use when purchasing fresh produce. The bags currently available are difficult for customers to use for several reasons. First, the bags tend to cling together and are difficult to separate from the roll. Second, it is difficult to tell the open end of the bags from the closed end of the bag. Third, the bags are difficult to open as the sides tend to cling together.

U.S. Pat. No. 5,732,833, commonly owned by applicant, discloses a dispensing assembly for supporting packs of plastic bags. The packs of plastic bags include a disposable upper portion connected to a lower bag portion.

Thus, there are a number of shortcomings with the known rolls of plastic bags and packs of plastic bags. A common problem with bag dispensing systems is presenting a plastic bag in a manner wherein it is easy to open and use.

SUMMARY OF THE INVENTION

Accordingly, a need has arisen for a rack for holding packs of plastic bags where a plastic bag is presented in a manner wherein it is easy to open and use the plastic bag.

In accordance with the present invention, a rack is provided for holding packs of plastic bags, comprising: a back support having two side protectors, a top rail operatively connected to the back support, the top rail having at least one hook designed for holding a pack of plastic bags with the back of a plastic bag against the back support and with the front of a plastic bag facing forward, wherein the two side protectors are designed to direct attention to the top center of the front of a bag such that it is easily opened.

Accordingly, an object of the present invention is to provide a rack for holding packs of plastic bags wherein it is easy to open and use a plastic bag.

BRIEF DESCRIPTION OF THE DRAWINGS

A better understanding of the invention can be obtained when the detailed description of exemplary embodiments set forth below is considered in conjunction with the attached drawings in which.

DETAILED DESCRIPTION OF THE EXEMPLARY EMBODIMENTS

The present invention relates to a rack for holding packs of plastic bags. As discussed further below, with packs of plastic bags, the back sheet of the bag is attached to an upper disposable section with a serrated line while the front sheet of the bag is not attached to the upper disposable section and remains open, although it is not readily visibly apparent that the front of the bag is open. It has been observed that most users of the packs of plastic bags remove a bag from the pack but many times pull a group or bundle of bags from the side at once, creating unnecessary bag waste. The present invention addresses this problem with the installation of side protectors on the rack. The side protectors deter a user from pulling the bags from the side and thus from removing more than one bag from the pack at any given time. The side protectors direct users to the upper center of the bag which is pre-open, allowing for single bag dispensing. The preferred method of using a bag is first to open the bag by pulling down on the open front sheet such that it separates away from the back sheet which is connected to the upper disposable section, placing product in the bag, and then tearing the back sheet at the serration to remove the bag from the pack. Preferably, instructions are printed on the front sheet to instruct the user to pull down on the front sheet to separate the front and back sheets, thereby opening the bag.

Figure 1:
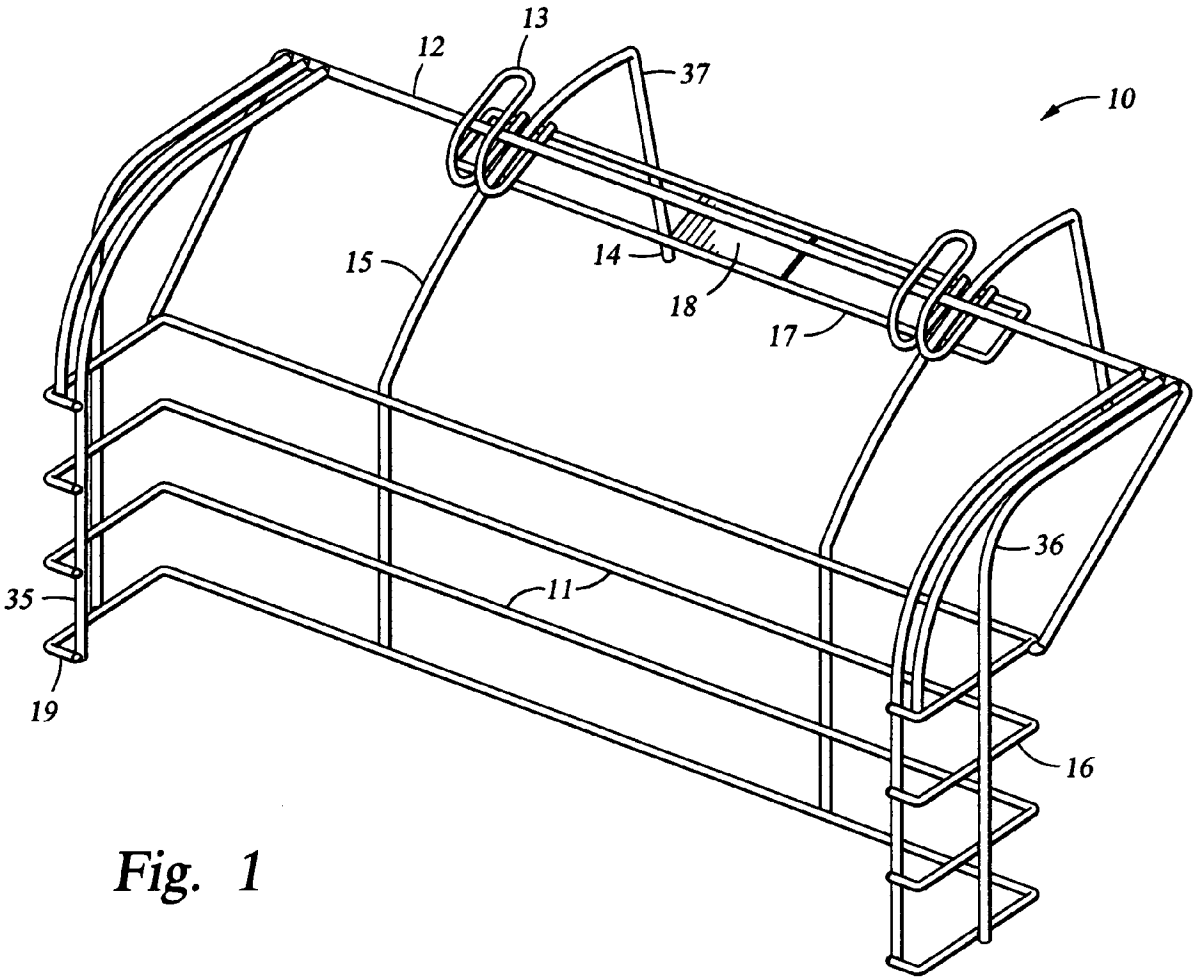
FIG. 1 is a perspective view of an embodiment of the present invention.

With reference to FIG. 1, a rack 10 is shown having a back support 11, side protectors 16, and a back support wire 15 which connects the back support 11 with a top rail 12. Preferably, the top rail 12 has two hooks 13 for holding the packs of plastic bags. The hooks 13 are preferably 8 inches apart, but could be set at any distance, e.g., 6 inches. Less preferably, the top rail 12 could have one hook 13.

The back support 11 is shown as four wires connected to a lower portion of the back support wire 15. The back support wire 15 holds the four wires in the correct position. The back support 11 is generally about 4 inches in height, but this could vary as desired. While the back support 11 is shown as a wire form, it may be constructed in any suitable way and of any suitable material, such as plastic or acrylic, and it may extend to any height, even up to the top rail 12. The back support 11 and the rack 10 are about 12 inches to 16 inches wide and may be any suitable width.

The side protectors 16 are formed by bending, at right angles, the four wires which make up the back support 11. While the side protectors 16 are shown as wire forms, they may be constructed in any suitable way and of any suitable material, such as plastic or acrylic, and they may extend to any height.

The back support wire 15 serves several functions; first, it is connected to the four wires in back support 11 to hold these wires in place. Also, it connects the back support 11 with the top rail 12. Further, as discussed below, it functions as a rack holder 37.

The top rail 12 extends the width of the rack 10 and serves several functions. First, the top rail 12 is connected to two hooks 13 which support the packs of plastic bags. Also, via the back support wire 15, the top rail 12 is connected to the back support 11. Further, as discussed below, the top rail 12 is connected to a hook support 17, a rack holder 37, a front rail 35 and a side rail 36.

The hooks 13 are generally constructed from a wire bent into a U-shape. Preferably, there are a pair of hooks 13 spaced 8 inches apart. If the hooks 13 were simply connected (e.g., by welding) to top rail 12, there would be significant stresses imposed upon the hook 13 connection due to the weight of the packs of plastic bags. To rectify this situation, a hook support 17 is used to lessen the stresses. Here, the hook support 17 is a rectangular wire form connected to the bottom of hooks 13 in two places and also connected to the top rail 12. A hook support plate 18, connected to the hook support 17, further relieves the stresses imposed on the hooks 13.

A front extension 19 and a front rail 35 further serve to prevent the removal of more than one bag and direct a user's attention to the top center of the front of the top plastic bag. The front extension 19 is formed from the four wires which make up the side protector 16. Here, the wires are bent at nearly right angles. The front rail 35 is connected to the ends of the four wires and curves upward to connect with the top rail 12. The front extension 19 may be constructed in any suitable way and of any suitable material, such as plastic or acrylic, and may extend to any height.

A side rail 36 extends from the top rail 12 to the bottom of the side protector 16. This side rail 36 serves several purposes; first, it is connected to each of the four wires in the side protector 16 to strengthen the side protector 16 and keep the wires in alignment. Also, it serves to deter a user from attempting to grasp a plastic bag from either side.

The rack 10 further comprises a rack holder 37 which as shown is an extension of back support wire 15. The wire holder 37 fits into the multiple cases' vents with multiple depths such that the rack 10 is placed about waist high. The rack holder 37 may be any suitable design for supporting the rack 10. Also, the rack 10 can be located in any suitable location.

Placing the rack 10 at about waist height further encourages a user to use the invention in the preferred method, which is first to open the bag by pulling down on the open front sheet such that it separates away from the back sheet which is connected to the upper disposable section, placing product in the bag, and then tearing the back sheet at the serration to remove the bag from the pack.

The rack 10 may be constructed of any suitable materials including, for example, stainless steel, plastic, or acrylic. Additionally, different parts of the rack 10 may be constructed of different materials.

The rack 10 is advantageous in that it takes up a minimal amount of space and is inexpensive to fabricate.

Figure 2:
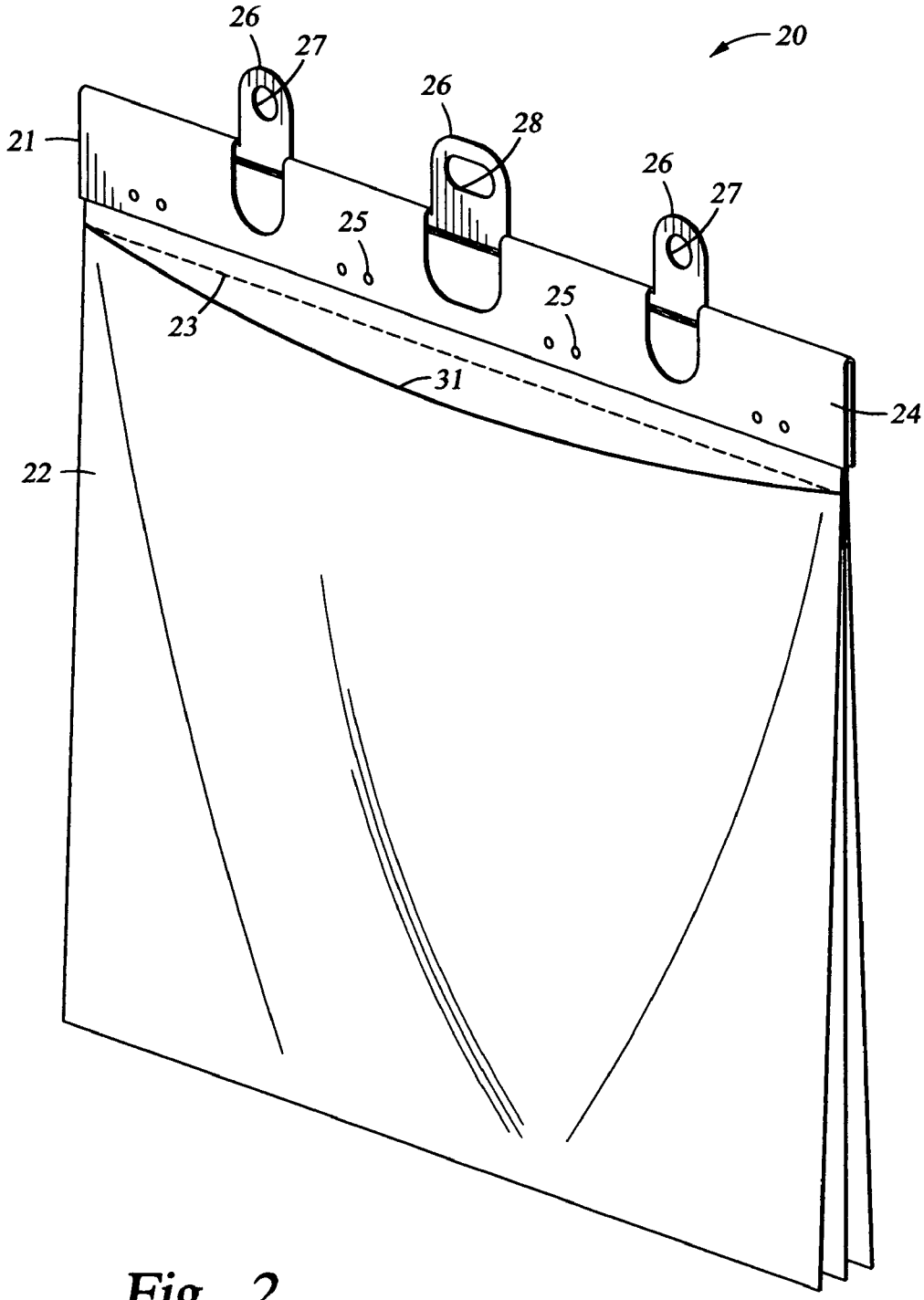
FIG. 2 is a front view of a pack of plastic bags having a header with tabs for attaching the pack to at least one support hook.

FIG. 2 shows a pack of plastic bags 20 wherein a number of individual bag units are joined together to form the pack 20. The individual bag units have a disposable upper portion 21 and a lower bag portion 22 with a serration 23 between the disposable upper portion 21 and the lower bag portion 22. In forming the pack 20, the individual bag units are stacked on top of each other, and a header 24 is placed about the disposable upper portion 21. The header 24 is formed by cutting a flat, generally rectangular plastic piece and folding the rectangular plastic piece longitudinally in half to substantially cover the disposable upper portions 21. FIG. 2 shows one embodiment of the header 24 wherein tabs 26 are cut from the header 24 (prior to folding the header 24 in half) and side holes 27 and center whole 28 are placed in the tabs 26. The tabs 26 are cut from the header 24 at 8 inches, 6 inches or any other suitable distance. The header 24 and the disposable upper portions 21 are joined together in any suitable way; preferably, the header 24 is joined to the disposable upper portions 21 by inserting heated blunt rods through the header 24 and the disposable upper portions 21 to melt the header 24 and the disposable upper portions 21 together about the points of insertion 25. The insertion of the heated blunt rods serve to melt the plastic immediately adjacent to the header 24 and the disposable upper portions 21 at the points of insertion 25 to join together the header 24 and the disposable upper portions 21 of the individual bag units. U.S. patent application Ser. No. 10/814,469, hereby incorporate by reference, discloses other means to fabricate packs of plastic bags and other header designs. For example, the header 24 can be perforated with holes at 8 inches, 6 inches or any other suitable distance. Also, the bags can be attached to paper headers and stapled together.

The individual bag units generally include a back sheet and a front sheet which are sealed around the sides and bottom to form the lower bag portions 22. The back sheet includes serration 23 and the disposable upper portions 21, while the front sheet terminates just below serration 23 to form a bag opening 31. The individual bag units formed with opening 31 allows a product to be placed in a bag while the bag remains attached to the pack of plastic bags 20 such that the user may then use two hands to remove the bag from the pack of plastic bags 20 and seal the bag. The individual bag units are most easily opened by pulling downward on the front sheet while the back sheet remains attached to the pack.

The material used to create the plastic bags may be any suitable plastic resin, including: low density polyethylene; linear low density polyethylene; high-density polyethylene; high molecular weight, high-density polyethylene; and polypropylene. The plastic film used to create the plastic bags may be either a single extruded layer or multiple, coextruded layers.

All patents referred to herein are hereby incorporated by reference in their entireties.

Having described the invention above, various modifications of the techniques, procedures, materials, and equipment will be apparent to those skilled in the art. It is intended that all such variations within the scope and spirit of the invention be included within the scope of the appended claims.

What is claimed is:

1. A rack for holding at least one pack of plastic bags, each plastic bag having a back sheet, a front sheet and an opening achieved by separating the front sheet from the back sheet, comprising:

a back support having two sides with a side protector connected on each side, the back support comprising a substantially vertical lower back support portion and an upper back support portion forming an angle with the lower back support portion, a top rail operatively connected to the back support, at least one book connected to the top rail above the upper back support portion, the at least one hook positioned and designed for holding at least one pack of plastic bags with a back of a plastic bag against the back support and with the front of a plastic bag facing forward, wherein the two side protectors are designed to direct attention to the top center of the front of a bag.

2. The rack of claim 1, further comprising a front extension and a front rail connected to the side protectors.

3. The rack of claim 1, wherein the side protectors further comprise a connected side rail.

4. The rack of claim 1, wherein the back support and side protectors are constructed of a plurality of wires.

5. The rack of claim 1, further comprising a rack holder connected to the rack.

6. The rack of claim 5, wherein the rack holder is connected to the top rail.

7. The rack of claim 5, wherein the rack holder is comprised of a wire holder.

8. The rack of claim 1, further comprising a hook support connected to the top rail.

9. The rack of claim 8, further comprising a hook support plate connected to the hook support.

10. The rack of claim 1, wherein the at least one hook is U-shaped.

11. The rack of claim 1, wherein there are two hooks spaced about 8 inches apart.

12. The rack of claim 1, wherein the rack has a width of about 12 inches to about 16 inches.

13. The rack of claim 1, wherein the two side protectors are designed to direct attention to the top center of the front of a bag which includes instructions to pull down on the front sheet.

14. A rack for holding at least one pack of plastic bags, each plastic bag having a back sheet, a front sheet and an opening achieved by separating the front sheet from the back sheet, comprising:

a top rail, at least one hook connected to the top rail for holding at least one pack of plastic bags, a back support wire connected to the top rail, a back support connected to the back support wire, the back support having a first lower portion and an upper angled portion extending from the first lower portion and being below the at least one hook, wherein the hook is positioned and designed to hold the pack of plastic bags against the angled portion of the back portion, and wherein the back support has two sides with a side protector connected on each side.

15. The rack of claim 14, wherein the side protectors are designed to direct attention to the top center of the front of a bag which includes instructions to pull down on the front sheet.

16. The rack of claim 14, further comprising a front extension and a front rail connected to the side protectors.

17. The rack of claim 14, wherein the side protectors further comprise a connected side rail.

18. The rack of claim 14, wherein the back support and side protectors are constructed of a plurality of wires.

19. The rack of claim 14, further comprising a rack holder connected to the rack.

20. The rack of claim 19, wherein the rack holder is connected to the top rail.

21. The rack of claim 19, wherein the rack holder is comprised of a wire holder.

22. The rack of claim 14, further comprising a hook support connected to the top rail.

23. The rack of claim 22, further comprising a hook support plate connected to the hook support.

24. The rack of claim 14, wherein the at least one hook is U-shaped.

25. The rack of claim 14, wherein there are two hooks spaced about 8 inches apart.

26. The rack of claim 14, wherein the rack has a width of about 12 inches to about 16 inches.

* * * * *